US008161584B1

(12) United States Patent
Del Rio

(10) Patent No.: US 8,161,584 B1
(45) Date of Patent: Apr. 24, 2012

(54) CRIB BUMPER AND MAT ASSEMBLY SYSTEM

(76) Inventor: Javier Del Rio, New Haven, CT (US)

( * ) Notice: Subject to any disclaimer, the term of this patent is extended or adjusted under 35 U.S.C. 154(b) by 0 days.

(21) Appl. No.: 13/178,223

(22) Filed: Jul. 7, 2011

(51) Int. Cl.

| | |
|---|---|
| ***A47C 21/08*** | (2006.01) |
| ***A47C 21/04*** | (2006.01) |
| ***A47D 15/00*** | (2006.01) |
| ***A47D 7/00*** | (2006.01) |
| ***A47D 13/06*** | (2006.01) |
| ***A47G 9/04*** | (2006.01) |

(52) U.S. Cl. ..... 5/424; 5/663; 5/946; 5/93.1; 5/496

(58) Field of Classification Search ..... 5/424, 425, 5/93.1, 663, 946, 496

See application file for complete search history.

(56) References Cited

U.S. PATENT DOCUMENTS

| | | | | |
|---|---|---|---|---|
| 3,570,026 | A * | 3/1971 | Allison | 5/486 |
| 4,873,734 | A | 10/1989 | Pollard | |
| 4,922,565 | A * | 5/1990 | Blake | 5/484 |
| 5,010,611 | A | 4/1991 | Mallett | |
| 5,042,099 | A * | 8/1991 | Brenner et al. | 5/502 |
| 5,086,530 | A * | 2/1992 | Blake | 5/484 |
| 5,241,718 | A * | 9/1993 | Pope | 5/424 |
| D365,957 | S | 1/1996 | Ferrari | |
| 5,881,408 | A | 3/1999 | Bashista et al. | |
| 5,933,885 | A * | 8/1999 | Glassford | 5/424 |
| 5,960,493 | A | 10/1999 | Rhey et al. | |
| D436,488 | S | 1/2001 | Johnson | |
| 6,178,573 | B1 * | 1/2001 | Wagner et al. | 5/424 |
| 6,243,895 | B1 | 6/2001 | Amin | |
| 6,823,543 | B2 | 11/2004 | Diak et al. | |
| 7,055,192 | B2 | 6/2006 | Waters et al. | |
| 7,487,560 | B2 * | 2/2009 | McGrath et al. | 5/488 |
| 2001/0000362 | A1 * | 4/2001 | Wagner et al. | 5/424 |
| 2009/0313755 | A1 | 12/2009 | Burrell, VI | |

* cited by examiner

*Primary Examiner* — Robert G Santos

(57) ABSTRACT

A bumper system having a fitted crib sheet with a secondary layer which is attached to a top surface of the fitted crib sheet using an attachment means which secures a perimeter of the secondary layer to the fitted crib sheet, a bumper component having a first, second, third and fourth side panel, wherein the bumper component is attached to the top surface of the fitted crib sheet so that when the fitted crib sheet engages a crib mattress, the bumper component extends upwardly with respect to the top surface of the fitted crib sheet, in which a bottom portion of the bumper is constructed from a material having mesh and a top portion of the bumper is constructed from a padded material, and an adjustable strap on the bumper component which has a latch where the adjustable strap is adapted to secure the bumper component to a slat of a crib.

3 Claims, 5 Drawing Sheets

(Cross-sectional View)

(In-use View)

(ISO Top View)

(ISO Bottom View)

(Top View)

(Cross-sectional View)

(In-use View)

CRIB BUMPER AND MAT ASSEMBLY SYSTEM

FIELD OF THE INVENTION

The present invention is directed to a bumper and mat system for cribs.

BACKGROUND OF THE INVENTION

The present invention is directed to a bumper and mat system for cribs. The system of the present invention provides greater protection against a baby getting a limb caught in the crib slats without the danger of asphyxiation. The system also prevents items (e.g., toys, pacifiers) in the crib from falling. Without wishing to limit the present invention to any theory or mechanism, it is believed that the system is practical and safe. The system may be beneficial in home nurseries as well as childcare facilities.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a bumper system for cribs. In some embodiments, the system comprises a fitted crib sheet; a secondary layer attached to the top surface of the fitted crib sheet via an attachment means, the attachment means secures the perimeter of the secondary layer to the fitted crib sheet; a bumper component comprising a first side panel, a second side panel, a third side panel, and a fourth side panel, the bumper component is attached to the top surface of the fitted crib sheet such that when the fitted crib sheet engages a crib mattress the bumper component extends upwardly with respect to the top surface of the fitted crib sheet, wherein a bottom portion of the bumper component is constructed from a material comprising mesh and a top portion of the bumper component is constructed from a padded material; and an adjustable strap disposed on the bumper component, the adjustable strap comprises a latch, the adjustable strap is adapted to secure the bumper component to a slat of a crib.

DESCRIPTION OF PREFERRED EMBODIMENTS

Figure 1:
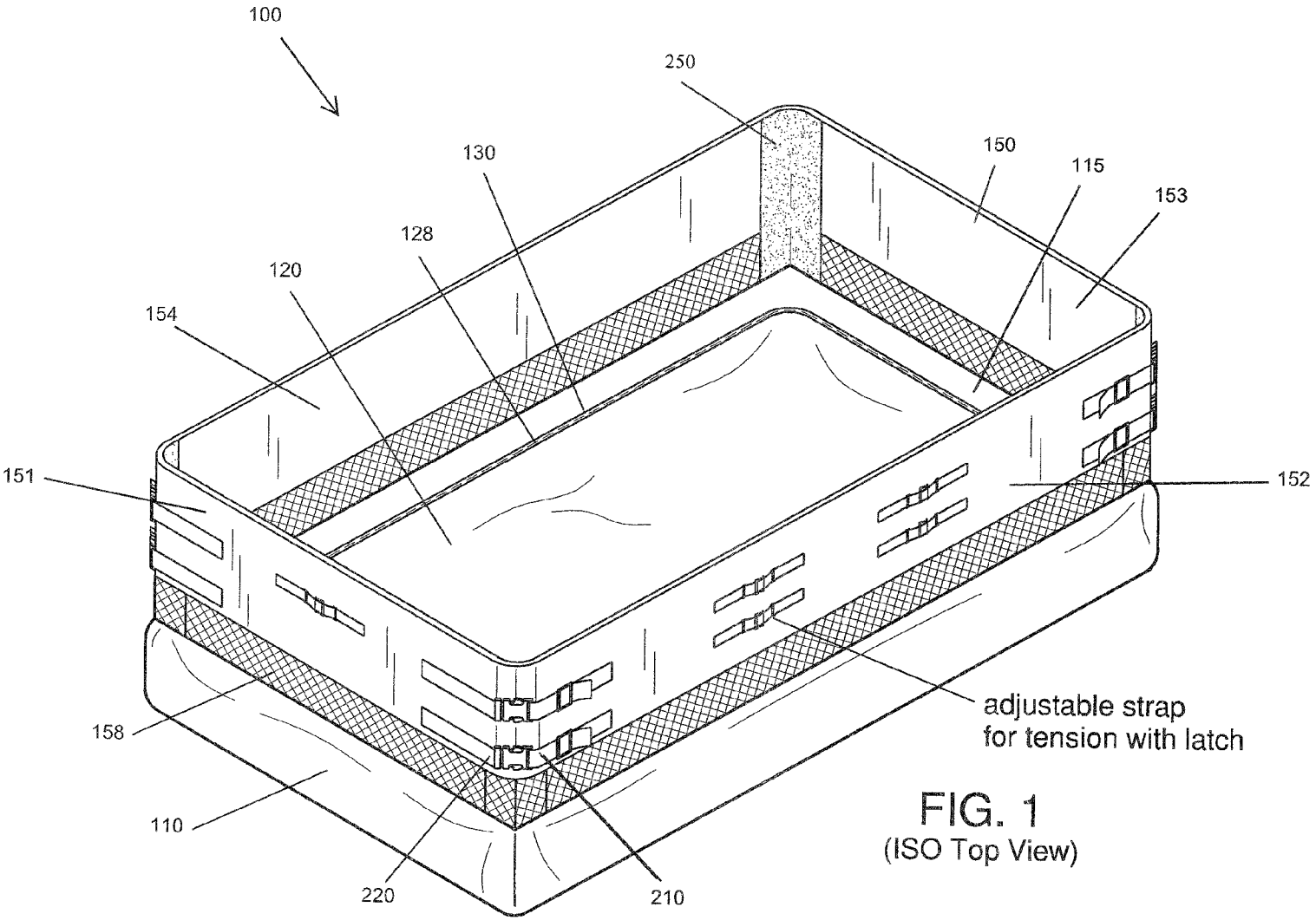
FIG. 1 is a top perspective view of the system of the present invention.
Figure 2:
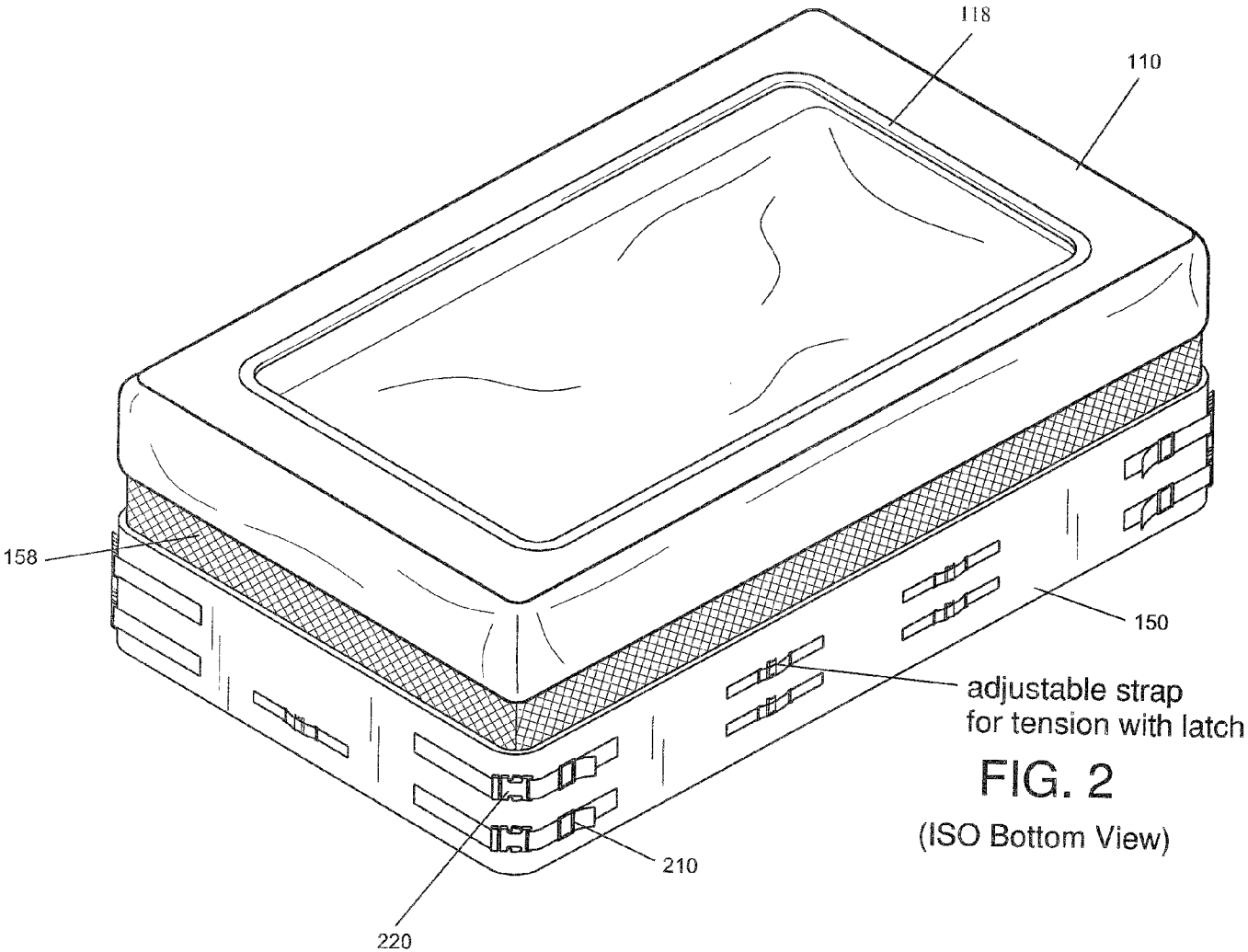
FIG. 2 is a bottom perspective view of the system of the present invention.
Figure 3:
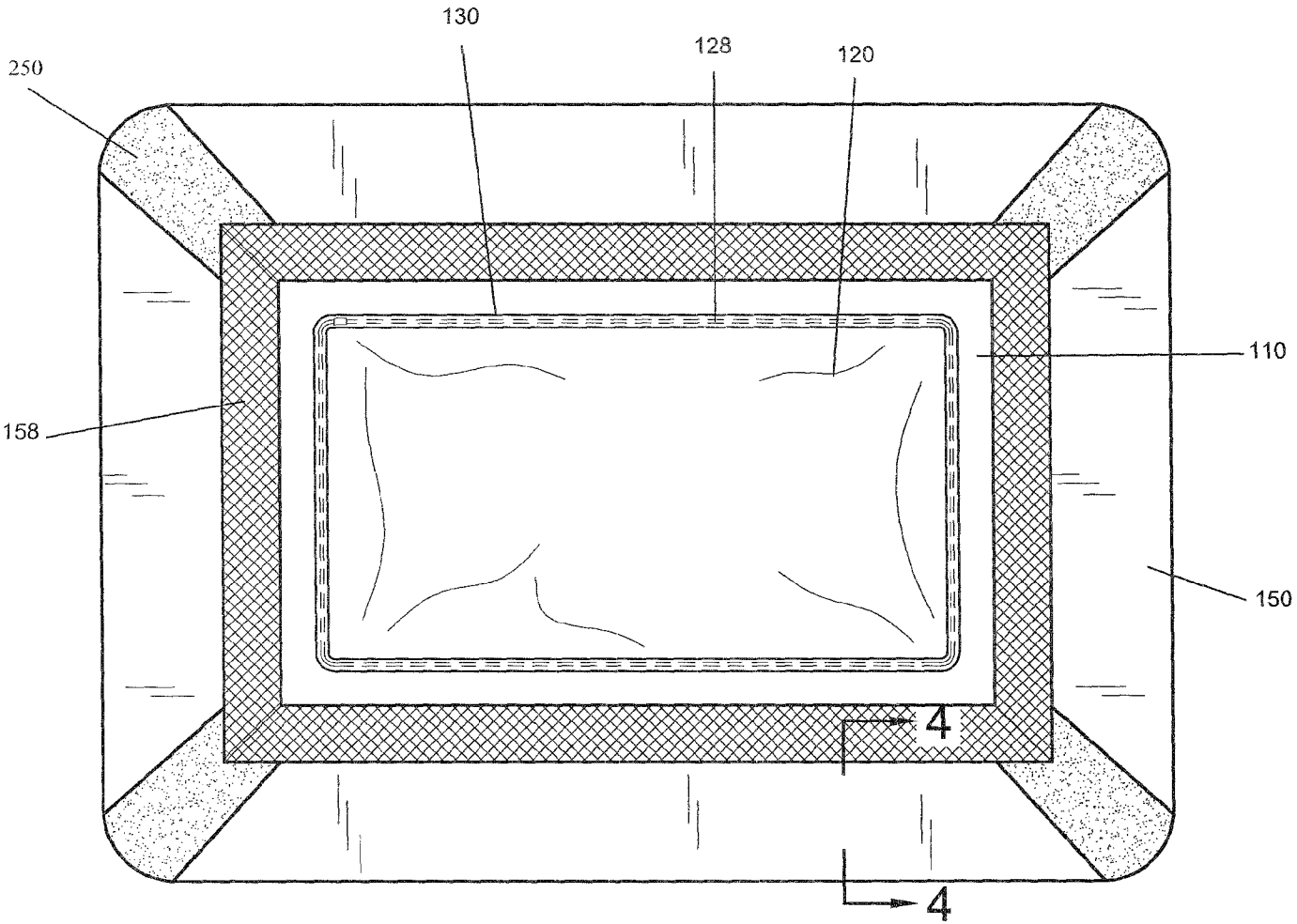
FIG. 3 is a top view of the system of the present invention.
Figure 4:
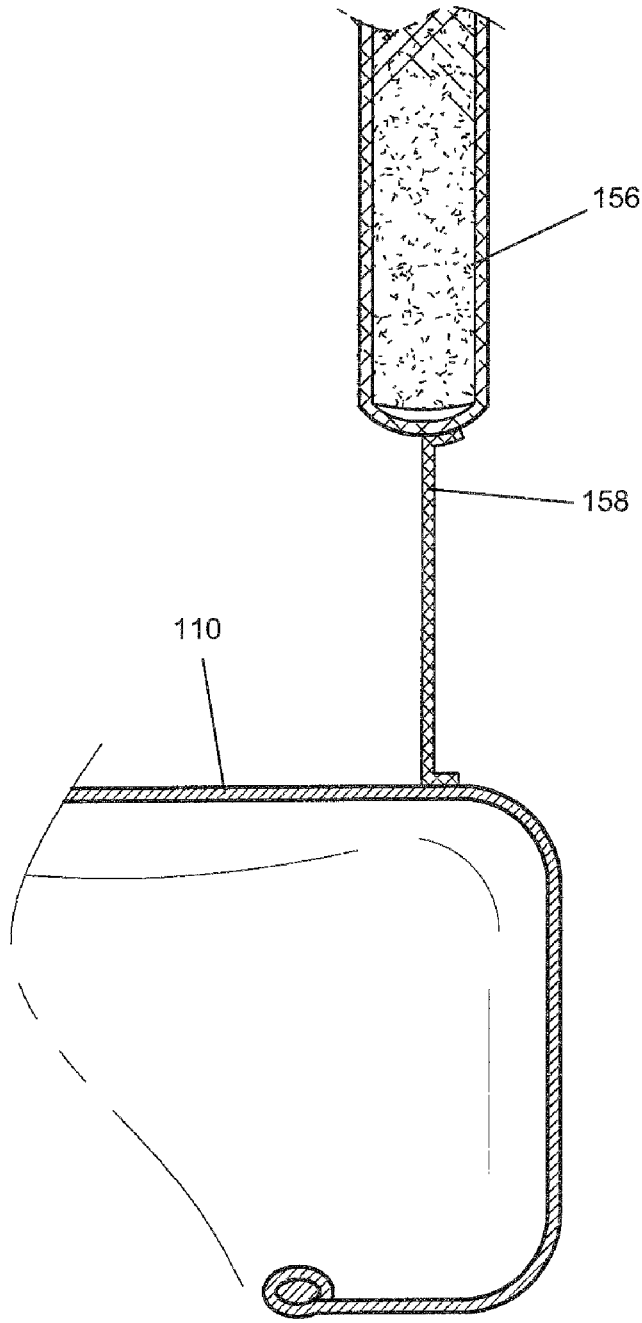
FIG. 4 is a cross-sectional view of the system of FIG. 3.
Figure 5:
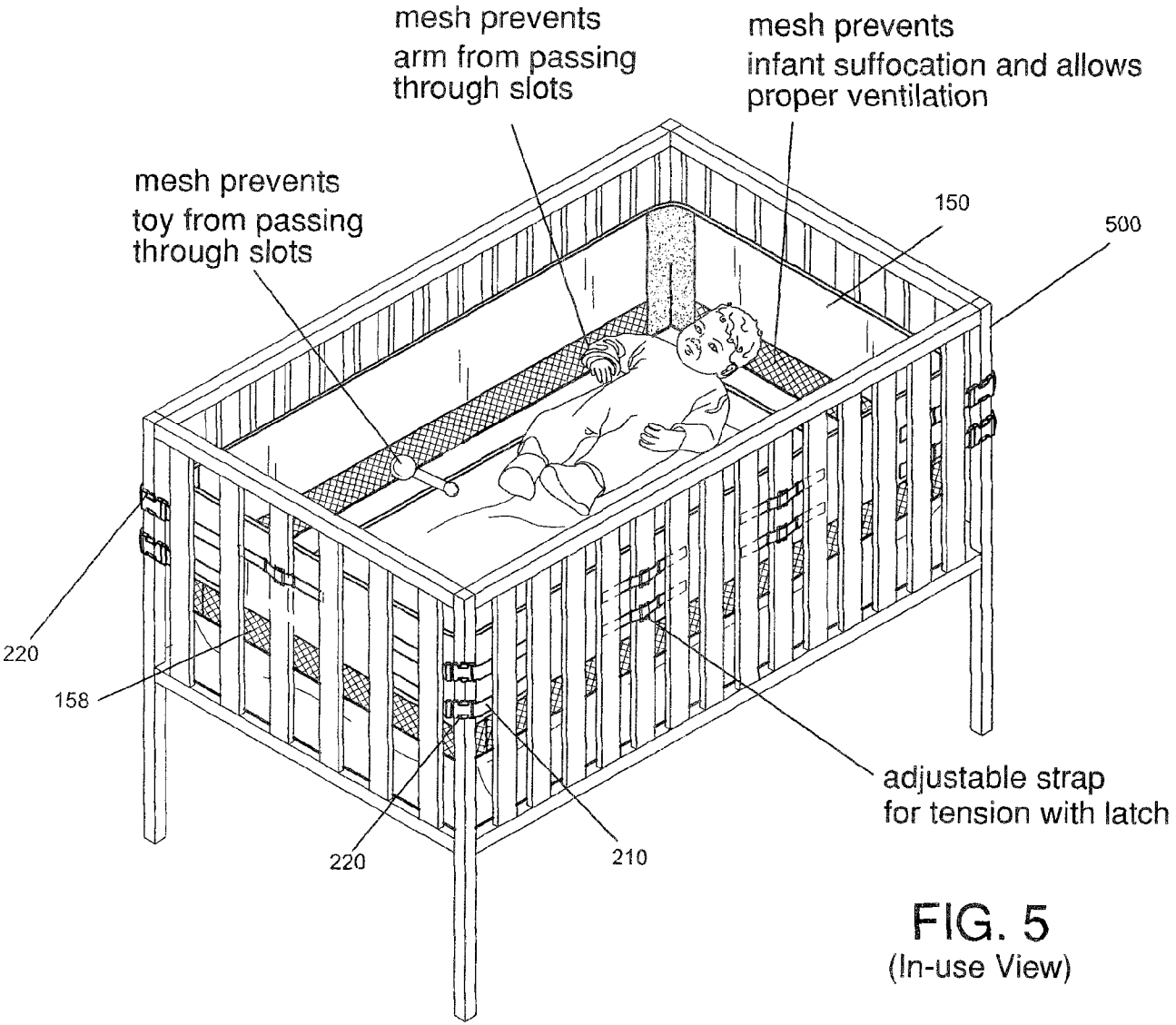
FIG. 5 is an in-use view of the system of the present invention.

Referring now to FIGS. 1-5, the present invention features a bumper system 100 for a crib 500. The system 100 comprises a fitted crib sheet 110. Fitted crib sheets are well known to one of ordinary skill in the art. For example, the fitted crib sheet 110 has a top surface 115, a bottom surface, and side edges that are lined with elastic 118 adapted to secure the sheet 110 on a crib mattress. FIG. 4 shows a side cross sectional view of the fitted crib sheet 110.

Disposed on the top surface 115 of the fitted crib sheet 110 is a secondary layer 120 (e.g., blanket, sheet). The secondary layer 120 is attached to the top surface 115 of the fitted crib sheet 118 via an attachment means (e.g., a zipper 128). For example, the attachment means may secure the entire perimeter of the secondary layer 120 to the fitted crib sheet 110. In some embodiments, a cover 130 (e.g., a cloth cover, etc.), for example a flap, is disposed along the edge of the attachment means so as to cover the attachment means and prevent the baby from contacting the attachment means.

Attached to the top surface 115 of the fitted crib sheet 110 is a bumper component 150. The bumper component 150 comprises a first side panel 151, a second side panel 152, a third side panel 153, and a fourth side panel 154. The bumper component 150 is attached to the top surface 115 of the fitted crib sheet 110 such that when the fitted crib sheet 110 engages a crib mattress the bumper component extends upwardly and contacts the inner surfaces of the crib slats (e.g., see FIG. 5).

The bottom portion 158 (the portion directly attached to the fitted crib sheet 110) of the bumper component 150 is constructed from a material comprising mesh or a mesh-like product. The top portion 156 of the bumper component 150 is constructed from a padded material and/or soft material.

In some embodiments, one or more adjustable straps 210 are disposed on the bumper component 150, for example the top portion 156 of the bumper component 150. The adjustable straps 210 each comprise a latch 220. The latches 220 allow the adjustable straps 210 to secure the bumper component 150 to the crib slats.

In some embodiments, a soft material 250 is disposed on the bumper component 150 at the intersections of the panels 151, 152, 153, 154.

The disclosures of the following U.S. patents are incorporated in their entirety by reference herein: U.S. Patent Application No. 2009/0313755; U.S. Pat. No. 5,010,611; U.S. Pat. No. 5,881,408; U.S. Pat. No. 5,960,493; U.S. Pat. No. 7,055,192; U.S. Pat. No. 4,873,734; U.S. Pat. No. 6,243,895; U.S. Pat. No. 6,823,543; U.S. Design Pat. No. D365957; U.S. Design Pat. No. D436488.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A bumper system 100 comprising:

(a) a fitted crib sheet 110;

(b) a secondary layer 120 attached to atop surface 115 of the fitted crib sheet 110 via an attachment means, the attachment means secures a perimeter of the secondary layer 120 to the fitted crib sheet 110;

(c) a bumper component 150 comprising a first side panel 151, a second side panel 152, a third side panel 153, and a fourth side panel 154, the bumper component 150 is attached to the top surface 115 of the fitted crib sheet 110 such that when the fitted crib sheet 110 engages a crib mattress the bumper component extends upwardly with respect to the top surface 115 of the fitted crib sheet 110, wherein a bottom portion 158 of the bumper component 150 is constructed from a material comprising mesh and a top portion 156 of the bumper component 150 is constructed from a padded material; and (d) an adjustable strap 210 disposed on the bumper component 150, the adjustable strap 210 comprises a latch 220, the adjustable strap 210 is adapted to secure the bumper component to a slat of a crib 500.

2. The system 100 of claim 1, wherein the attachment means is a zipper 128.

3. The system 100 of claim 1 further comprising a cover 130 disposed along an edge of the attachment means functioning to cover the attachment means.

* * * * *